US008317631B2

(12) United States Patent
Rentz et al.

(10) Patent No.: US 8,317,631 B2
(45) Date of Patent: Nov. 27, 2012

(54) SEATED SELF-PROPELLED MERRY-GO-ROUND

(76) Inventors: Felton Rentz, Kissimmee, FL (US); Sue Ellen Rentz, Kissimmee, FL (US)

( * ) Notice: Subject to any disclaimer, the term of this patent is extended or adjusted under 35 U.S.C. 154(b) by 191 days.

(21) Appl. No.: 12/830,319

(22) Filed: Jul. 3, 2010

(65) Prior Publication Data

US 2012/0004045 A1 Jan. 5, 2012

(51) Int. Cl.
*A63G 1/20* (2006.01)
*A63G 1/00* (2006.01)

(52) U.S. Cl. ..... 472/5; 472/14

(58) Field of Classification Search ..... 472/14–16, 472/19–21, 32–33, 108, 109, 112, 115, 121; 482/72, 95, 96
See application file for complete search history.

(56) References Cited

U.S. PATENT DOCUMENTS 1,308,568 A * 7/1919 Wreisner ..... 472/19
1,670,882 A * 5/1928 Eckberg ..... 472/1
2,544,589 A * 3/1951 Cummings ..... 472/4
2,680,616 A * 6/1954 Furman et al. ..... 472/19
2,699,335 A * 1/1955 Krueger, Jr. ..... 472/19
2,835,491 A * 5/1958 Meyers ..... 472/5
2,895,734 A * 7/1959 Pittaluga ..... 472/5
2,919,131 A * 12/1959 Dimitriadis ..... 472/5
3,172,659 A * 3/1965 Daleiden ..... 472/24
3,758,108 A * 9/1973 Tada ..... 472/5
4,489,932 A * 12/1984 Young ..... 472/14
5,330,390 A * 7/1994 Liebert et al. ..... 472/23
5,885,163 A * 3/1999 Bjorn et al. ..... 472/5
5,921,867 A * 7/1999 Mayeux ..... 472/19

* cited by examiner

*Primary Examiner* — Kien Nguyen
(74) *Attorney, Agent, or Firm* — Jerry Haynes; Law Office of Jerry D. Haynes

(57) ABSTRACT

A merry-go-round includes: a body where the body includes an upper tubular sleeve, an upper beam with a set of chair braces at each end on top of the body, a set of horizontal supports between the body and the set of chair braces; a base including a lower tubular sleeve, a plurality of legs and a plurality of feet; a base support bar connected to the plurality of legs beneath the base; a rotating bar with an upper portion and a lower portion. The merry-go-round also includes a set of chairs; a propelling mechanism; a propelling bar fastened to the rotating bar at an end and attached to the lower connection points at an opposing end, wherein the propelling mechanism enables the merry-go-round to turn when the rider pushes and pulls the handles and thrusts and relaxes against the foot bar.

7 Claims, 3 Drawing Sheets

SEATED SELF-PROPELLED MERRY-GO-ROUND

BACKGROUND OF THE INVENTION

1. Field of the Invention

The present invention relates to a merry-go-round that is self-propelled by the riders sitting in a set of chairs on the device.

2. Description of Related Art

For years a common amusement park and playground staple has been a merry-go-round. Children love to ride on the spinning device, and adults have fond memories from when they were a child. The typical merry-go-round consists of a stationary base, with a spinning platform and multiple handles. The riders could sit on the platform while another person used the handles to push the merry-go-round around and around. Another option for the rider is to run alongside the merry-go-round, holding a handle and when the merry-go-round is spinning fast enough the rider jumps onto the platform. This is not only exhausting for the rider but also dangerous should the user trips or falls next to the merry-go-round. Many of the amusement park merry-go-rounds, also known as carousels, are machine operated, wherein a motorized engine turns the platform enabling the merry-go-round to spin.

A problem with most non-motorized merry-go-rounds is that an external force must be used to keep the device spinning Either a person must continuously push, or one of the riders must repeatedly dismount. Some rider-propelled merry-go-rounds have been invented to improve upon the classic merry-go-round. These devices allow the rider to utilize a handle to crank turning portion of the platform. The handle enables one or more riders to turn the merry-go-round without the assistance of a third person. While the rider-propelled merry-go-rounds are a vast improvement on the classic merry-go-round, they still fall short as far as safety and deconstruction. These rider propelled merry-go-rounds have small seats which do not securely hold a child, and they are meant to be constructed and then left without ever being deconstructed.

It would be desirable in the art to have a merry-go-round which was not only self-propelling but also included safety features to protect the children riding the device. It was also be beneficial to have a merry-go-round which may be deconstructed when not in use or during inclement weather.

SUMMARY OF THE INVENTION

The present invention provides a self-propelling merry-go-round with a set of chairs for the riders. The each chair includes a seat and a back, so that the riders may comfortably and securely sit on the merry-go-round. The chairs also include seat belts to ensure that the riders do not fall out of their seats while playing on the merry-go-round. Another safety feature of the merry-go-round includes a protective foam sleeve that covers the body portion and the upper beam to shield the metal framework of the merry-go-round from the riders.

Another object of the present invention is that the merry-go-round may be deconstructed and stored in a storage shed or garage when not in use or during inclement weather.

Another object of the present invention is to provide children with a means of exercise. The riders turn the merry-go-round is turned when push and pull on the handle, while thrusting and relaxing a foot bar. The motions required to operate the merry-go-round provide the children with a beneficial cardiovascular activity. Not only is the merry-go-round fun and used for entertainment but it is also an enjoyable exercise device.

These together with other aspects of the present invention, along with the various features of novelty that characterize the present invention, are pointed out with particularity in the claims annexed hereto and form a part of this present invention. For a better understanding of the present invention, its operating advantages, and the specific objects attained by its uses, reference should be made to the accompanying drawings and descriptive matter in which there are illustrated exemplary embodiments of the present invention.

BRIEF DESCRIPTION OF THE DRAWINGS

The advantages and features of the present invention will become better understood with reference to the following detailed description and claims taken in conjunction with the accompanying drawings, wherein like elements are identified with like symbols, and in which:

Like reference numerals refer to like parts throughout the description of several views of the drawings.

DETAILED DESCRIPTION OF THE DRAWINGS

The present invention relates to a self-propelling merry-go-round to provide entertainment and exercise for its riders. The merry-go-round may have a set of chairs at opposing ends for the riders to sit and safely use the device. Included with the chairs may be a seat belt so that the riders will not fall off the merry-go-round while spinning The merry-go-round may operate when the riders exert energy to push and pull the handles while thrusting and relaxing the foot bar, wherein the coordinating propelling bars may enable the merry-go-round to turn. The energy exerted by the riders may also provide an excellent form of exercise. The riders may enjoy the entertainment qualities of the merry-go-round, while benefiting physically.

Figure 1:
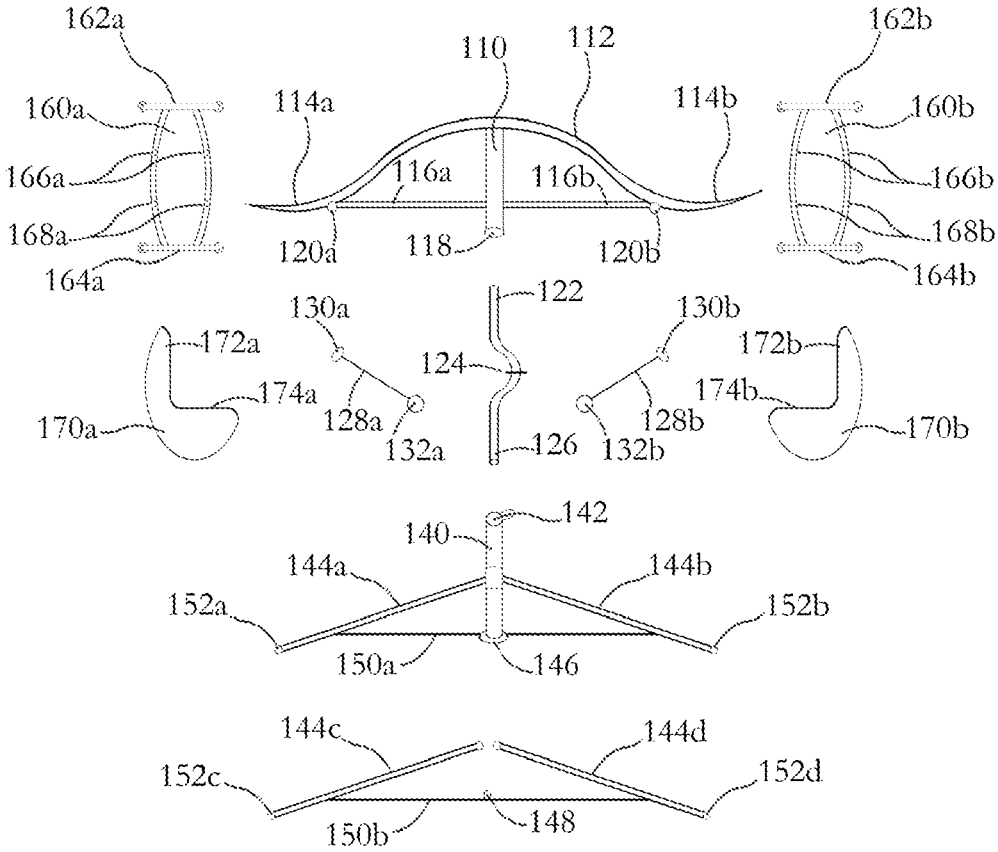
FIG. 1 is a perspective view of the parts of a merry-go-round in accordance with an exemplary embodiment of the present invention.

Turning now descriptively to the drawings, referring to FIG. 1, a perspective view of the parts of a self-propelling merry-go-round (100) (hereinafter merry-go-round) is shown in accordance with an exemplary embodiment of the present invention. The merry-go-round (100) may comprise a body (110), a stationary bar (124), a base (140), a set of propelling means (160*a* and 160*b*) (hereinafter propelling means) and a set of chairs (170*a* and 170*b*) (hereinafter chairs). The body (110) may have an upper beam (112) with a set of seat braces (114*a* and 114*b*) (hereinafter seat braces) at each end. The upper beam (112) may be soldered to the body (110) and may have a curved (as shown) or angled shape. The seat braces (114*a* and 114*b*) may brace against a set of horizontal supports (116*a* and 116*b*) (hereinafter horizontal supports) wherein the seat braces (114*a* and 114*b*) and the horizontal supports (116*a* and 116*b*) meet at a set connection points (120*a* and 120*b*) (hereinafter connection points).

The body (110) and all of its elements may be made from metal or a hard plastic strong enough to support the weight of a person without warping or bending. The upper beam (112)

and the body (110) may be covered with a protective foam sleeve to protect a user from the hard metal or material used to make the body (110). The upper beam (112) including the seat braces (114*a* and 114*b*) may have a width of 5 feet or more depending on the desired size of the merry-go-round.

The body (110) may have an upper tubular sleeve (118) where an upper portion of the rotating bar (122) may be inserted. The stationary bar (124) may have a lower portion (126), which may fit into a lower tubular sleeve (142) on the base (140). A set of propelling bars (128*a* and 128*b*) (hereinafter propelling bars) may be attached to the stationary bar (124) at an end (132*a* and 132*b*). The motion of the propelling bars (128*a* and 128*b*) may enable the upper tubular sleeve (118) to turn the stationary bar (124).

The base (140) may have a plurality of legs (144*a*, 144*b*, 144*c* and 144*d*) (hereinafter legs) to support the weight of the merry-go-round (100). The legs (144*a*, 144*b*, 144*c* and 144*d*) may be a tube or rod made of metal for strength and stability. At a distal end of the legs may be a plurality of feet (152*a*, 152*b*, 152*c* and 152*d*) (hereinafter feet). The feet may comprise a cap or blunt stop to prevent the legs (144*a*, 144*b*, 144*c* and 144*d*) from pushing into the ground. The base (140) may a base hollow (146) at a lower end. A set of base support bars (150*a* and 150*b*) (hereinafter base support bars) may connect opposing legs (144*a*, 144*b*, 144*c* and 144*d*) beneath the base (140). A joint (148) may be at the center of one of the base support bars (150*b*) and inserts into the base hollow (146). The joint (148) ensures that the base support bars (150*a* and 150*b*) do not shift or slide beneath the weight of the merry-go-round (100).

The chair braces (114*a* and 114*b*) support a set of chairs (170*a* and 170*b*) (hereinafter chairs) under a seat (174*a* and 174*b*) of the chairs (170*a* and 170*b*). The chairs (170*a* and 170*b*) may have a back (172*a* and 172*b*) to help hold a rider in the chair (170*a* and 170*b*). The chairs (170*a* and 170*b*) may include a bucket style seat (174*a* and 174*b*) for a comfortable and secure feel for the rider. The chairs (170*a* and 170*b*) may have a seat belt to ensure that the rider does not injure themselves while using the merry-go-round (100). In one exemplary embodiment, the chairs (170*a* and 170*b*) are at opposing ends of the merry-go-round (100), along each end of the upper beam (112).

The propelling means (160*a* and 160*b*) enables the rider to rotate the merry-go-round (100). In one exemplary embodiment, the propelling means (160*a* and 160*b*) comprise a set of bars with a handle (162*a* and 162*b*) at one end and a foot bar (164*a* and 164*b*) at an opposing end. The foot bar (164*a* and 164*b*) may have a stirrup or pedal to ensure that the rider's feet stay on the foot bar (164*a* and 164*b*). The propelling means (160*a* and 160*b*) includes an upper connection point (166*a* and 166*b*), and the upper connection point (166*a* and 166*b*) joins to the upper beam (112) at the connection point (120*a* and 120*b*) . The propelling means (160*a* and 160*b*) also includes a lower connection point (168*a* and 168*b*). The lower connection point (168*a* and 168*b*) joins the propelling means (160*a* and 160*b*) to an opposite end (130*a* and 130*b*) of the propelling bars (128*a* and 128*b*). As the rider pushes and pulls the handle (162*a* and 162*b*) and thrusts and relaxes the foot bar (164*a* and 164*b*) the motion causes the propelling bars (128*a* and 128*b*) to move thus the merry-go-round (100) may rotate. One or more riders may rotate the merry-go-round (100) allowing the merry-go-round to be self-propelling.

Figure 2:
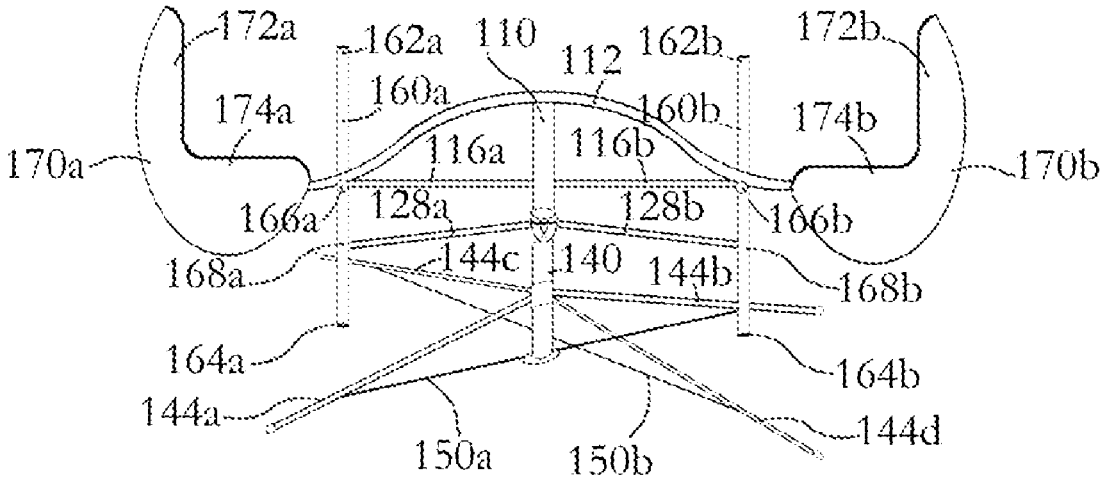
FIG. 2 is a perspective view of a merry-go-round in accordance with an exemplary embodiment of the present invention.

Referring to FIG. 2, a perspective view of the merry-go-round (100) is shown in accordance with an exemplary embodiment of the present invention. FIG. 2 shows how the elements may relate to each other when the merry-go-round (100) is fully assembled.

Figure 3:
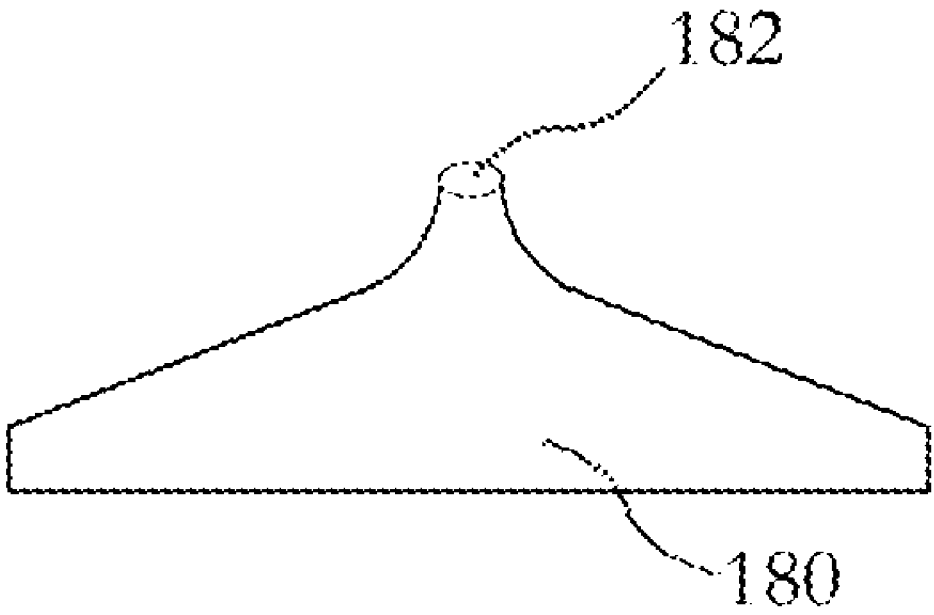
FIG. 3 is a perspective view of an enclosed base of a merry-go-round in accordance with an alternative embodiment of the present invention.

Referring to FIG. 3, a perspective view of an enclosed base (180) in accordance with an alternative embodiment of the present invention is shown. The enclosed base (180) may have a hollow opening (182). The hollow opening (182) accepts the lower portion (126) of the stationary bar (124). The enclosed base (180) may be used to house the base (140) of the merry-go-round (100). The enclosed base (180) may also serve as a protective cover so that the rider will not trip or injure themselves on the legs (144*a*, 144*b*, 144*c* and 144*d*) or feet (152*a*, 152*b*, 152*c* and 152*d*).

The merry-go-round may be completely self-propelled so that only the riders are required to make the merry-go-round spin. The merry-go-round provides a form of exercise for the rider with all of the pushing and pulling on the handles and thrusting and relaxing on the foot bars, so that the rider not only has an enjoyable experience, but also receives a workout. The protective foam sleeve may be colorful or have decorative designs printed on them thus serving not only a safety function but also an aesthetic purpose. The chairs may also be decorated or colored to be appealing to the riders. When the merry-go-round is not in use or during inclement, the parts may be easily disassembled and stored in a garage or storage shed until the rider is ready to use it again.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The exemplary embodiment was chosen and described in order to best explain the principles of the invention and its practical application, to thereby enable others skilled in the art to best utilize the invention and various embodiments with various modifications as are suited to the particular use contemplated.

What is claimed is:

1. A merry-go-round comprising;

a body including an upper tubular sleeve;

an upper beam with a set of chair braces at each end on top of the body;

a set of horizontal supports between the body and the set of chair braces;

a base including a lower tubular sleeve, a plurality of legs and a plurality of feet;

a base support bar connected to the plurality of legs beneath the base, wherein the base includes a base hollow at a lower end to accept a base joint at the center of one of the base support bars;

a rotating bar with an upper portion and a lower portion, where the upper portion inserts into the upper tubular sleeve and the lower portion inserts into the lower tubular sleeve;

a set of chairs with a seat and a back on the set of chair braces to allow a rider to sit on the merry-go-round;

a propelling means including a handle, a foot bar, a set of upper connection points joined to the horizontal support bar and a set of lower connection points; and a propelling bar fastened to the rotating bar at an end and attached to the lower connection points at an opposing end, wherein the propelling means enable the merry-go-round to turn when the rider pushes and pulls the handles and thrusts and relaxes against the foot bar.

2. The merry-go-round of claim 1, wherein the body and the upper beam is covered with a protective foam sleeve.

3. The merry-go-round of claim 1, wherein the chair is a bucket seat.

4. The merry-go-round of claim 3, wherein the bucket seat includes a seat belt.

5. The merry-go-round of claim 1, wherein the foot bar includes a pedal.

6. The merry-go-round of claim 1, wherein the foot bar includes a stirrup.

7. The merry-go-round of claim 1, wherein the base is enclosed in a protective cover.

* * * * *